United States Patent [19]

Elford

[11] 3,964,239

[45] June 22, 1976

[54] PACKAGING MACHINE

[76] Inventor: Peter Ellice Elford, 3 Wincroft Road, Caversham, Reading, Berkshire, England

[22] Filed: Jan. 23, 1975

[21] Appl. No.: 543,529

[52] U.S. Cl. ..... 53/196; 53/207

[51] Int. Cl.[2] ..... B65B 5/02; B65B 5/06

[58] Field of Search ..... 53/191, 183, 184, 228, 53/220, 194, 159, 196, 207

[56] References Cited

UNITED STATES PATENTS

| | | | |
|---|---|---|---|
| 2,685,157 | 8/1954 | Doepel et al. | 53/228 |
| 3,110,143 | 11/1963 | Schooler | 53/220 |
| 3,332,207 | 7/1967 | Midnight | 53/207 |
| 3,530,640 | 9/1970 | Hoffmann | 53/159 X |
| 3,531,905 | 10/1970 | Omori | 53/207 X |
| 3,683,586 | 8/1972 | Duckhinsky et al. | 53/228 |

*Primary Examiner*—Travis S. McGehee
*Assistant Examiner*—Horace M. Culver
*Attorney, Agent, or Firm*—Hill, Gross, Simpson, Van Santen, Steadman, Chiara & Simpson

[57] ABSTRACT

A forming-die-less packaging machine makes packages, consisting of an array of articles in a carton, preferably one of tray-like form, by receiving a carton blank and, upon it, the requisite array of articles upon a platform forming a first positioning arrangement in the machine; this platform then descends past an opposed pair of adjustable but stationary members which erect wall portions of the carton on two opposed sides, one or both of the opposed members then moving to move the partly-formed package to a second positioning arrangement where another opposed pair of walls are erected.

13 Claims, 6 Drawing Figures

PACKAGING MACHINE

This invention relates to packaging machines and is more particularly concerned with machines for forming packages each comprising a carton containing an array of articles, such as cans, bottles, jars or packets; the carton of each package is preferably of tray form and the package itself is formed by positioning the array of articles upon a carton blank and erecting wall portions of the carbon blank around the array to form the carton. In essence, the machine is supplied with the articles to be packaged and a series of carton blanks, the articles are formed into predetermined arrays and then an array and a carton blank are formed into the desired package.

Packaging machines of this type are known. In particular, various machines of this kind are described in British Patent Specification No. 1279629, filed 23rd July 1968, British Patent Specification No. 1351141, filed 9th Feb. 1970, and British Patent Specification No. 1381712, filed 18th Mar. 1971, in the name of P. E. Elford. Many prior machines of this type are subject to the disadvantage that they are generally designed to form packages of a particular size from carton blanks of a particular size, so that such machines cannot readily be adapted to form packages of a different size from blanks of a different size. A further disadvantage of some prior machines of this type is that they employ forming dies to erect at least some of the walls of the carton. Forming dies are normally expensive to make and each die can only be used with a particular size of blank. Machines incorporating forming dies are generally subject to a further disadvantage; in particular, as the blank and the array of articles on it have to be moved right down through the die, there is a corresponding maximum height restriction on the articles which can be packaged in a particular machine.

Various features of the present invention are directed towards overcoming or at least substantially alleviating the above-mentioned disadvantages.

In accordance with one aspect of the present invention, a packaging machine is provided, for forming packages, each comprising an array of articles in a carton, from supplies of the articles and of carton blanks, the machine comprising a first carton blank positioning arrangement adjustable to suit carton blanks of different dimensions, such arrangement serving to receive and locate a blank and, upon such blank, one or more articles or groups of articles sufficient to form the desired array, such positioning arrangement including a downwardly-movable platform for supporting the blank as the array of articles is formed thereon and a forming-die-less pair of adjustable opposed members arranged, upon downward movement of the loaded platform, to erect an opposed pair of wall portions of the blank around the array and to hold such wall portions in the erected position, at least one of the opposed members being movable to allow the blank with the array thereon to move from the platform to a second positioning arrangement for erection of another opposed pair of wall portions of the blank.

In the operation of a machine of the present invention, typically a downwardly-movable platform is provided on which a blank, with an array of products or articles thereon, may be placed; the machine includes means whereby the loaded platform, i.e. together with the blank and the array of articles thereon, is moved downwardly between a pair of opposed members, the function of which is to erect an opposed pair of wall portions of the blank around the array of articles and, then, when it reaches the bottom of the downward stoke, the platform is located such that the first-mentioned pair of wall portions are kept erected around the articles by means of the pair of opposed members. One of these members is then moved so as to push the partly-formed package from the platform to another part of the machine arranged to complete the erection of the blank into a carton, the other member being movable out of the path of movement of the partly-formed package during this operation. With this arrangement, no forming die is needed and, also the pushing member normally needed in any event to move the partly-formed package from the platform is also used for erecting one wall of the blank.

This other one of the opposed pair of members is preferably moved back into place, once the partly-formed package has been pushed from the platform, so that it can be used to hold erect that wall previously erected by the pushing member.

In a particularly advantageous arrangement described in more detail hereinbelow, the downwardly-movable platform and the pushing member are so arranged that the former can be returned to its upper position, ready to receive the next blank and array, before the pushing member is retracted to its original position. This enables the speed of operation of the machine to be maximised.

The part of the machine which is operated and arranged so as to complete the erection of the blank may include means for applying adhesive to the other two wall portions of the blank and means for thereafter erecting such wall portions, so as to assembly a complete tray-like carton around the array of products or articles. Desirably, in order to facilitate adjustment of the machine to function with blanks of different sizes, the operative portions of that part of the machine, together with the other one of the pair of members, preferably, are movable with respect to the platform in the direction in which the partly-formed packages are received by the operative portions of the machine.

The blanks may be fed to the platform by hand, although they are desirably supplied automatically by a blank feeder.

The blank feeder is desirably movable in the direction in which it supplies blanks to the platform, again to facilitate adjustment of the machine to function with different blank sizes.

For the same reason, that one of the pair of members which acts as a pusher is also desirably adjustably positionable in the pushing direction.

In a preferred form of machine described in more detail below, blanks are supplied to the platform from one side and partly-formed packages are pushed off from the other side. Articles are fed on to the blank on the platform from a direction at right-angles to the direction of blank feed and package withdrawal.

The invention will be more readily understood from the following description of a packaging machine in accordance with the present invention and carton blanks suitable for use with the machine, reference being made to the accompanying drawings, in which.

Figures 1, 3:
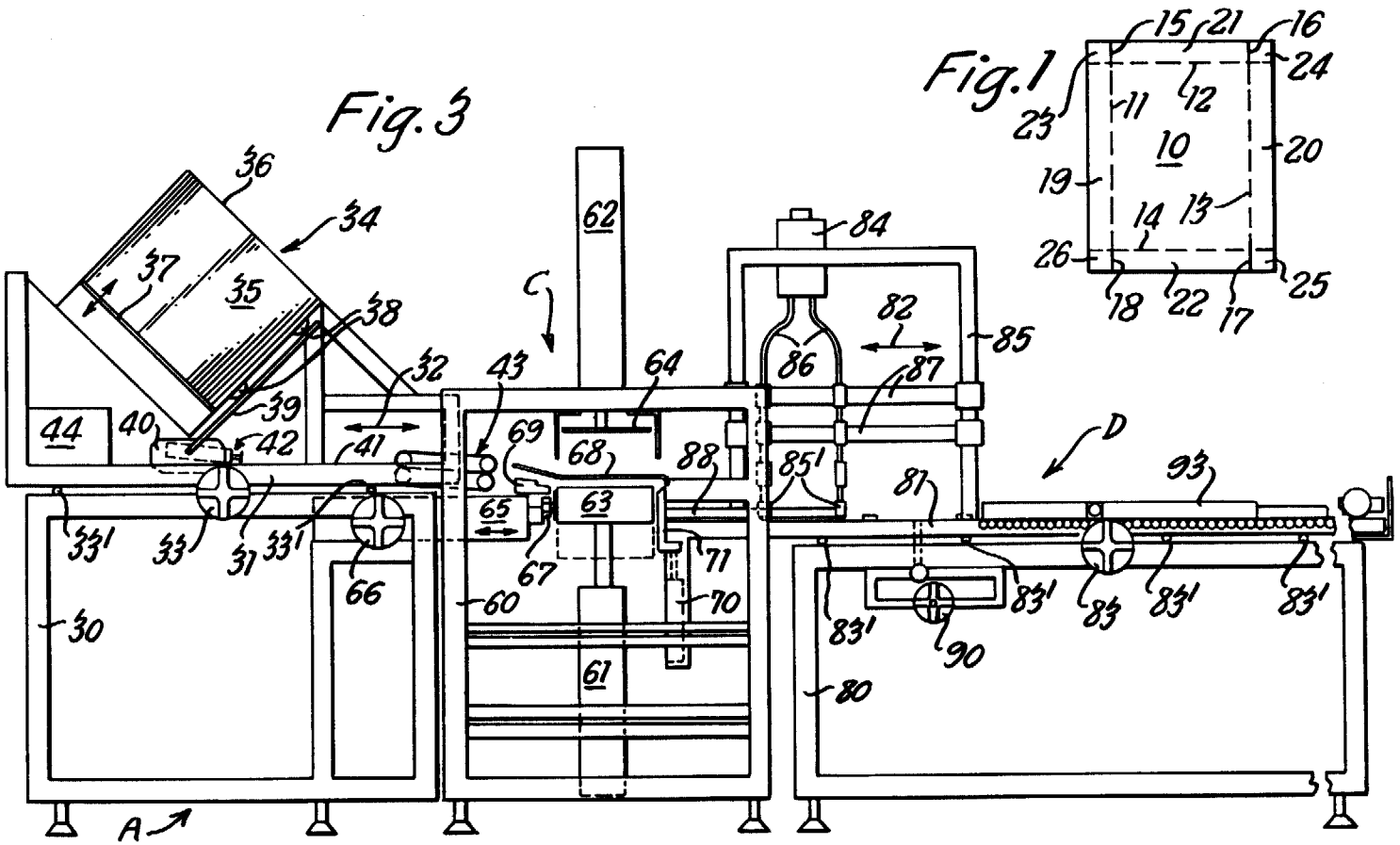
FIG. 1 shows a plan view of a carton blank, of a simple kind, forming when erected a rectangular tray, score lines being shown by dotted lines and slits by full lines.
FIG. 3 shows a side elevational view of packaging one form of machine suitable for forming packages from tray blanks according to FIG. 1, the article feeding apparatus being omitted for the sake of clarity.

One form of carton blank suitable for use in the packaging machine described hereinbelow is shown in FIG. 1. The blank is made of paper, paperboard, plastics sheet or any other suitable material. The blank comprises a rectangular base portion 10 defined by four score lines 11 to 14, which lines, together with four slits 15 to 18, define two opposed pairs of wall portions namely side wall portions, 19, 20 and end wall portions 21 and 22 and four corner tabs 23 to 26. The blank is erected into a tray-form carton by first erecting the opposed side wall portions 19, 20 i.e. by turning them upwardly through 90°, and then turning the four corner tabs 23 to 26 inwardly through 90°. Erection is completed by erecting the other opposed pair of end wall portions 21, 22, these wall portions being adhesively secured to the outsides of the corner tabs 23 to 26, e.g. by means of adhesive applied to the ends of the wall portions 21, 22 before their erection.

Figure 2:
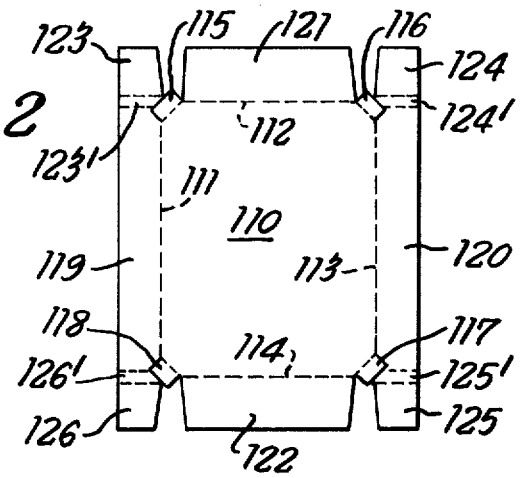
FIG. 2 shows a plan view of an alternative form of carton blank, forming when erected a rectangular tray with corner walls at 135° to the side and end walls, of the kind disclosed in British Patent Specification No. 1363654, score lines and slits being shown as in FIG. 1.

Another and more complex form of carton blank is shown in FIG. 2. This comprises a rectangular base portion 110 defined by four score lines 111 to 114, which lines defined two opposed pairs of wall portions, namely side wall portions 119, 120 and end wall portions 121, 122. At each end, each side wall portion 119, 120 carries one of four corner tabs 123 to 126, each being respectively joined to the end of the appropriate side wall portion 119, 120 by one of four intermediate tap portions 123' to 126'. At the corners of the base portion 110, a corner part 115 to 118 is provided, being defined by a score line intersecting the respective pair of the four lines 111 to 114 at an angle of 135° and by three cuts. The base of each corner part 115 to 118 represented by the score lines intersecting the lines 111 to 114 equals the width of the adjacent tap portions 123' to 126'. The blank is erected into a tray-form carton by first erecting the corner parts 115 to 118 and then the opposed side wall portions 119, 120, i.e. by turning them upwardly through 90°, the end wall portions 121, 122 are then erected and the corner tabs 123 to 126 are brought into contact with and adhered to the ends of the wall portions 121, 122. The blank thus forms an octogonal tray having four corner walls at 135° to the two pairs of opposed main side and end walls. An array of articles of circular plan e.g. cans or bottles, can thus be formed very advantageously into a package on such a tray, with the outermost articles contacting the tray walls on all sides and the corner articles also contacting the corner walls. In contrast to a package made from a blank according to FIG. 1, a package made from a FIG. 2 blank also has the advantage of excluding sharp projecting corners.

For convenience, in the following description of FIGS. 3 and 4, operation of the packaging machines is described with reference to use of blanks of the type shown in FIG. 1. However, such description is merely illustrative as the machine can be used with carton blanks of other types. The machine shown in FIGS. 5 and 6 may be used with 135° corner-type tray blanks of the kind shown in FIG. 2. When the machine is used with the 135 corner-type blank, additional means, (not shown or described hereinafter) is provided for erecting the corner reinforcing tabs of the blank prior to erection of the walls.

Figure 4:
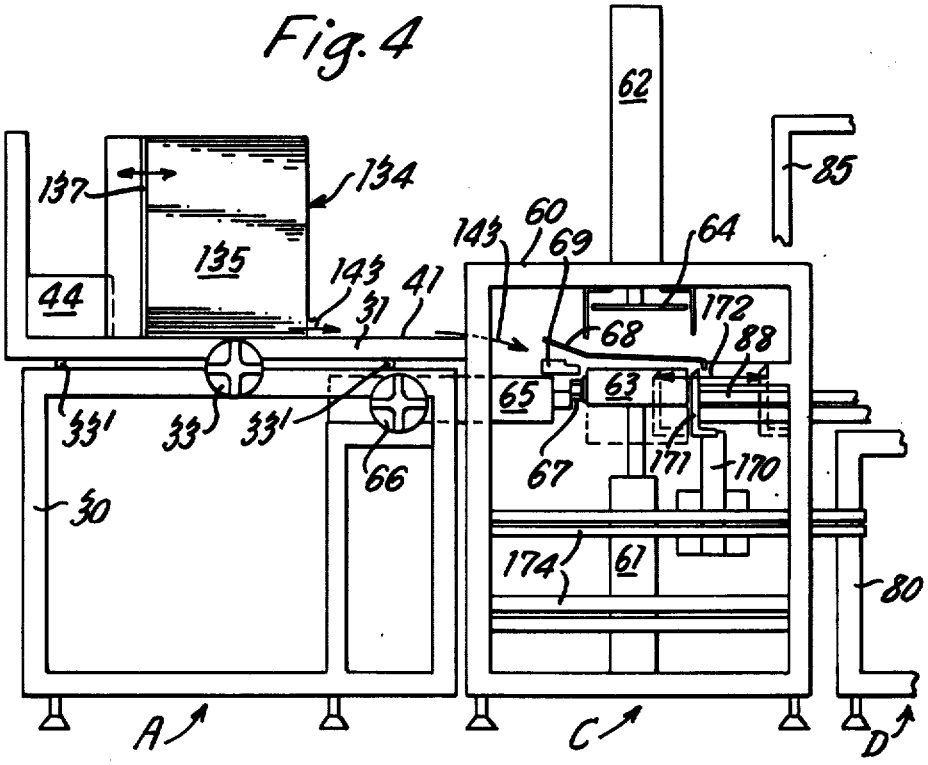
FIG. 4 shows a part-elevational view similar to FIG. 3, showing an alternative form of the blank feeding and initial erection sections of the packaging machine.
Figure 5:
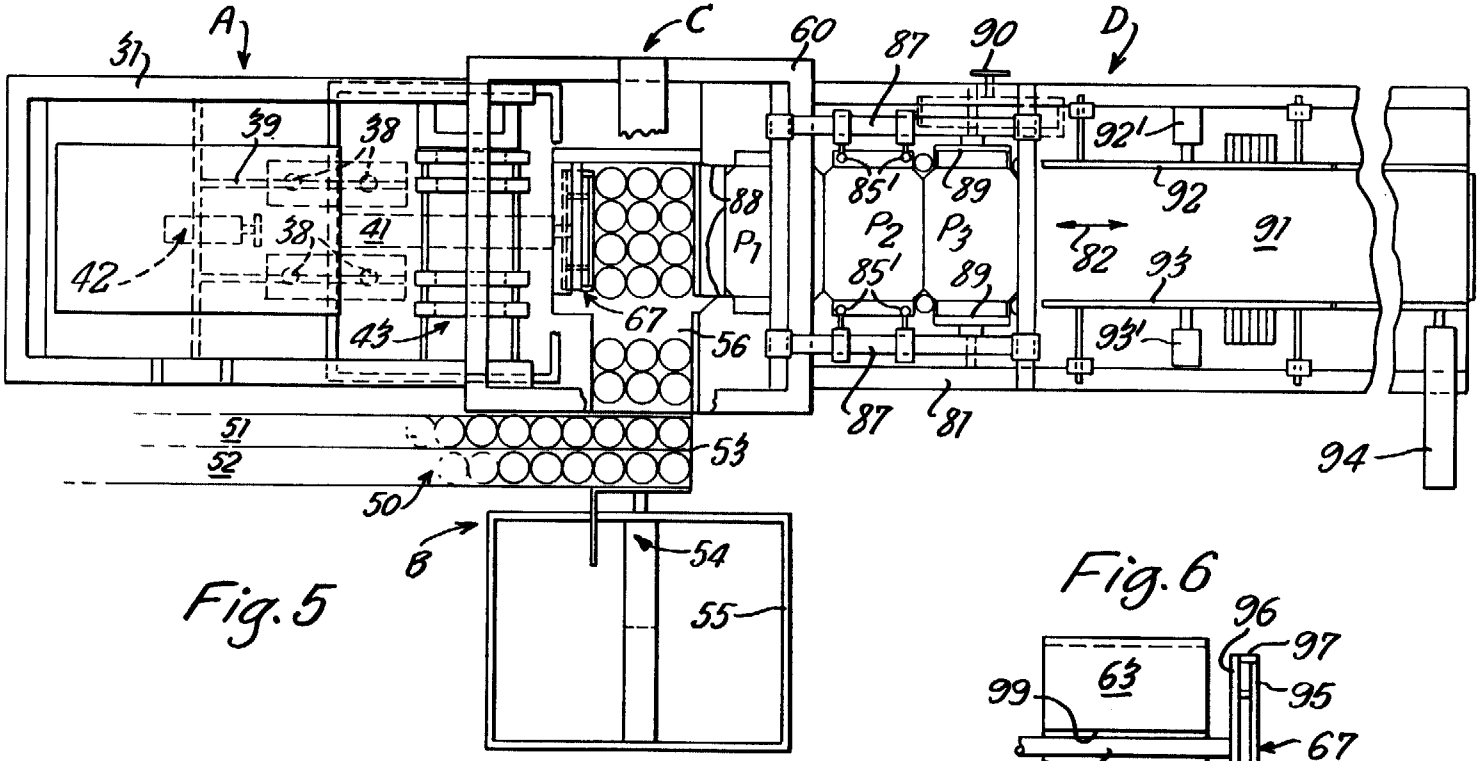
FIG. 5 shows a top plan view of the machine shown in FIG. 3 with some parts omitted for clarity.

The packaging machines illustrated in FIGS. 3, 4 and 5 comprise four main parts, viz. an automatic blank feeding section A, (FIGS. 3, 4 and 5) an article feeding section B, (FIG. 5) a loading and initial erection section C, (FIGS. 3, 4 and 5) and a glueing and final erection section D (FIGS. 4 and 5). The construction of each of the sections will be described in turn.

The automatic blank feeding section A (FIG. 3) comprises a fixed frame 30 having a secondary frame 31 mounted thereon. The frame 31 is movable with respect to the frame 30 in the direction of the arrow 32, movement being effected by turning a handwheel 33 which operates a suitable form of mechanism (now shown), e.g. a rack and pinion gear arrangement. Rollers 33' assist the movement.

The operative parts of the automatic blank feeding section A, now to be described, are mounted upon the movable framework 31. The main part of the blank feeding arrangement includes a hopper 34 mounting a stack 35 of tray blanks. Referring to FIG. 1, the blanks are mounted in the hopper 34 so that the edge of each blank on the right or left in FIG. 1 lies against the edge 36 of the stack 35. An adjustable backrest 37, movable in the direction of the arrow shown, permits the hopper to accomodate tray blanks of different sizes.

Tray blanks are removed from the stack 35, one at a time, by means of vacuum-operated sucker pads 38 mounted on a frame 39 pivotable downwardly from the position shown under the action of a torque unit 40. In operation, the sucker pads remove the lowest blank from the stack 35 and deposit it upon a horizontal receiving surface 41, the surface being suitably apertured to allow the frame 39 and the pads 38 to travel downwardly through it to free the blank for subsequent movement. A miniature pneumatic piston and cylinder arrangement 42 is arranged to nudge each blank deposited on the receiving surface 41 into a nip-roller and belt arrangement 43 continuously driven by an electric motor 44.

The modified form of automatic blank feeding section A (FIG. 4) differs from that shown in FIG. 3 as regards the parts mounted on the secondary frame 31. A hopper 134 contains a stack 135 of carton blanks arranged so that the individual blanks are horizontal and their rear edges are butted against an adjustable vertical stop plate 137. Each blank is drawn in turn from the foot of the stack 135 by conveyor means of conventional kind (therefore not shown in detail) and is fed to the adjacent loading and initial erection section C as indicated by the arrows 143. The conveyor means are driven by the motor indicated diagrammatically at 44.

The article feeding section B (FIG. 5) comprises a continuously moving conveyor 50 having, in the arrangement illustrated, two article delivery lanes 51 and 52. A dead plate 53 at the exit of the conveyor 50 receives and holds a column of three articles from each lane, as shown in FIG. 5. A pneumatic piston and cylinder pusher arrangement 54 attached to a fixed frame 55 pushes groups of six articles from the dead plate 53 into an article entry lane 56 of the loading and initial erection section C, two operations being required to load the machine with an array of 12 articles.

It will be apparent that the particular configuration of the article feeding section B illustrated is exemplary and may readily be modified, if required. For example, the dead plate 53 can be enlarged to take columns of more than three articles, and the conveyor 50 can have more than two lanes. For example, the conveyor 50 can have four lanes and the pneumatic pusher arrangement 54 can comprise a first pusher mounted on a second pusher so as to double the speed of pushing movement whilst retaining the same cushioning effect. In this way, a single operation suffices to load the machine with an array of 12 articles.

The loading and initial erection section C (FIG. 3) comprises a fixed frame 60 mounting a pair of pneumatic piston and cylinder pusher arrangements 61 and 62. The arrangement 61 mounts a platform 63 for downward movement from the position shown in full lines to that shown in dotted lines. The arrangement 62 is operative to move a pusher plate 64 downwardly from the position shown.

A further pneumatic piston and cylinder pusher arrangement 65 is mounted, for convenience, on the fixed frame 30 of the automatic blank feeding section A (FIGS. 3, 4 or 5). The arrangement 65 is adjustable in position in the direction of the arrow shown, i.e. in its operative direction, adjustment being effected by turning a handwheel 66. The pusher 65 is operative to move a pusher plate assembly 67 horizontally to the right from the position shown.

A pair of guide members 68, 69 are arranged near the exit of the nip roller and belt arrangement 43 to receive a blank emerging from the latter in such manner as to correctly dispose it on the platform 63. A limit switch (not shown) which can be a mechanically operated pneumatic switch, a photoelectric cell or some other suitable form of switch, is arranged to detect when a blank is correctly located on the platform 63.

A further pneumatic piston and cylinder pusher arrangement 70 is mounted on the frame 81 of the glueing and final erection section D, which is movable as described below.

In the modified form of apparatus shown in FIG. 4, a preferred feature is illustrated, whereby the pneumatic piston and cylinder arrangement 70 in the initial erection section C is mounted not only for vertical adjustability and movability of the wall retaining plate 171, but also for horizontal adjustability in the feed direction of the packages, as indicated by the arrow 172. Extreme fore and aft positions for the plate 171 are illustrated diagrammatically in broken lines. In practice, these extreme positions can lie anywhere along the length of the machine, the arrangement 170 being mounted upon a longitudinal support shown at 174. In this way, the entire section C is adaptable to the erection of blanks of a wide range of sizes and also avoids the restrictions imposed, in other machines, where dies of fixed configuration have to be used.

The glueing and final erection section D comprises a fixed frame 80 mounting a second frame 81. The second frame 81 is mounted with respect to the fixed frame 80 in the direction of the arrow 82, movement being effected by turning a handwheel 83. Rollers 83' assist the movement. An adhesive container 84 is mounted on a further frame 85 secured to the movable frame 81. Four adhesive applicator heads 85' are connected to the adhesive container 84 by respective pipes 86. The pipes 86 are slidably mounted on horizontal bars 87 forming part of the framework 85 so that the positions of the heads 85' can be adjusted in the direction of the arrow 82. The bars 87 are slidably mounted on cross members of the frame 85 so that the positions of the heads 85' can be adjusted in the direction of the arrow 82', FIG. 5. The mounting for the heads 85' and their associated pipes 86 also allows for the heads and pipes to be adjusted perpendicularly. A pair of opposed guides 88 are provided to guide partly formed cartons received from the platform 63, in its lower position, into the glueing and final erection stage D. A pair of wall erection plates 89 are provided where shown in FIG. 3 to erect the walls 21, 22 of the blank after adhesive has been applied to them by the applicator heads 85'. The plates 89 can be moved laterally of the direction of movement of the package by turning a handwheel 90 and also in the direction of the arrow 82' in FIG. 5 by another adjustment wheel (not shown). A compression and adhesive setting portion 91 of the glueing and final erection section D is provided to finalize erection of the packages. In this portion, a pair of plates 92, 93 are provided to push against the sides of the package to ensure good adhesion of the walls 20, 21 of the blank to the corner tabs 21 to 24. Preferably, the walls 92 and 93 are retracted slightly whilst the packages are moving, by means of pneumatic piston and cylinder arrangements 92', 93', so that the cartons do not bind and become deformed. The walls 92, 93 are movable inwardly and outwardly of the path of movement of the packages.

At the end of the compression and adhesive setting portion 91, a final pneumatic pusher arrangement 94 is provided for ejecting complete packages from the machine, e.g. on to a conveyor leading to a further machine where a shrink wrapping is applied around the package.

The manner of operation of the machines described above is essentially the same and will now be explained. In the description of operation, reference is made to various parts of the machine becoming operative at appropriate times. The manner of controlling and interrelating sequential operations, and the provision of interlocks to ensure that certain operations will only occur if other operations have previously been effected, will be apparent to those skilled in the art and will therefore not be described.

The first operation in the sequence is the location of a blank on the platform 63 in the upper position of the latter as shown in full lines in FIGS. 3 and 4. Suction is applied to the sucker pads 38, which are in the positions shown in FIG. 3, and the frame 39 is then pivoted downwardly by the torque unit 40, the pads carrying the lowermost blank in the stack 35 down into them. In FIG. 4, the motor 44 serves to operate the stack 135 so as to advance the lowest blank therefrom. Once the blank has been deposited on the horizontal receiving surface 41, the trailing edge of the blank is given a nudge by the pneumatic pusher 42, (FIG. 3) which shunts the leading edge of the blank into the input of the nip-roller and belt arrangement 43, which thereupon accelerates the blank and "shoots" it between the guides 68 and 69 so that it is deposited in the correct position on the platform 63. In FIG. 4, this is effected by the movement indicated by the arrow 143. Reception of the blank is detected by the above-mentioned limit switch, which thereafter enables inception of the next stage of the operation, i.e. the feeding of an array of articles onto the blank disposed on the platform. The sucker pad frame 39 is meanwhile returned by the torque unit 40 to its original position.

When the blank is correctly disposed on the platform, the pusher arrangement 54 of the article feeding section B thereupon performs two indexing operations which causes two groups of six articles to be deposited upon the blank in an array of 12 as shown in FIG. 5. The pusher 54 thereafter ceases operation until it is next required. In this position of the machine, the blank is located on the platform 63 and 12 articles are disposed symmetrically upon the blank so that they lie in an ordered array within the bounds of the rectangular base section 10. (FIGS. 1 and 2). The pusher plate 64 is then moved downwardly by the pusher 62 so that it abuts the top of the articles and pushes the blank and platform with the array of articles and pushes the blank and platform with the array of articles thereon downwardly from the position of the platform shown in full lines in FIG. 3 to that shown in dotted lines. The stroke of the movement is approximately 10 cm., and causes the blank and the articles thereon to pass downwardly between the pusher plate assembly 67 and the wall retaining plate 71 of the glueing and final erection stage D. Passage of the blank and articles down between these members causes the two members to erect the opposed wall portions 19 and 20 of the blank into vertical positions. At the bottom of the vertical stroke, these two walls are held erect by the two members. Immediately the bottom of the stroke is reached, the plate 71 is retracted downwardly out of the way by the cylinder and piston arrangement 70 and the pusher plate assembly 67 is moved outwardly to push the partly formed package from the platform into the glueing and final erections section D. The corner tabs 24 and 25 of the tray are moved inwardly through 90° as the package is pushed between the guides 89, the guides 89 being appropriately mutually spaced for this purpose. The other corner tabs 23, 26 are turned inwardly by the action of the pusher plate assembly 67, in a manner now to be described with reference to FIG. 6. The tray blank of FIG. 2 is erected in a guidor manner the additional surfaces required for holding the walls and tubes in place whilst glueing takes place being shown in section D (FIG. 5). As can be seen from FIG. 6, the pusher plate assembly 67 comprises a pusher plate 95 attached by a lost motion connection to a plate 96 having corner forming portions 97, 98. During movement of the pusher assembly, the lost motion causes the plate 96 to move towards the plate 95 such that the corner forming portions 97 and 98 turn the tabs 23 and 26 inwardly through 90°.

Figure 6:
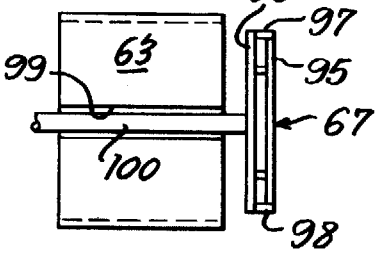
FIG. 6 shows a scrap top plan view of the platform and wall erector/pusher assembly of the machine shown in FIGS. 3 and 5.

Once the partly formed package has been moved into the glueing and final erection section D, the platform 63 can be returned to the upper position and the pusher plate assembly 67 returned to its initial position ready for the next operation. As the speed with which the platform is returned to its upper position is the most important factor, as until this has been done so that the platform is ready to receive a further blank the next cycle of the machine cannot be commenced, the platform 63 and the pusher assembly 67 are so arranged that the platform can be returned to its upper position before the pusher plate assembly 67 is retracted. Referring to FIG. 6, it will be seen that the platform 63 is of box-like configuration with a hollow interior and has a slot 99 in and extending across its upper edge. The slot 99, which clears the operating rod 100 of the piston and cylinder arrangement 65, enables the platform to be returned to its upper position whilst the pusher plate assembly 67 is still extended, the pusher assembly thereafter being retracted through the hollow interior of the platform.

As soon as retraction of the pusher plate assembly 67 commences, the wall retaining plate 71 is returned to the position shown in FIG. 3 where it holds erect the wall 19 of the carton. The partly formed carton is then in the position shown at $P_1$ in FIG. 5. The opposite wall 20 is held erect by contact with the package previously part-formed by the loading and initial erection section C of the machine.

The next cycle of operation of the machine takes place, and when the next partly-formed package is pushed into the glueing and final erection section D the previously partly-formed package at position $P_1$ is indexed along by the entry of the fresh partly-formed package until it is in that position shown in FIG. 5 underneath the adhesive applicator heads 85 and designated $P_2$. The four heads adhesive applicator heads 85' are then moved downwardly to apply four blobs of adhesive to the walls 21, 22 of the blank in the positions shown. During the next operation of the machine, this package is then indexed along to the next position ($P_3$) in the glueing and final erection section D, at which position the plates 90 are turned through 90° to erect the remaining two walls 21, 22 the adhesive previously applied causing them to adhere to the outsides of the corner tabs 23 to 26. The next few successive cycles of operation of the machine index the package through the compression and adhesive setting section 91 and the package finally emerges from this portion, with the adhesive set, whereupon it is removed from the machine by the pusher arrangement 94.

The machine described can be readily adapted to operate to form different sized packages. The backrest 37 or 137 of the automatic tray blank feeding section A is adjusted to conform with the new blank length.

The position of the blank feeding section A is adjusted to conform with the new blank length by turning the handwheel 33, and the rest postion of the pusher assembly 67 is adjusted, for the same reason, by turning the handwheel 66. A fresh pusher assembly 67 and wall retaining plate 71 are fitted to conform with the new blank width. Alternatively, in the embodiment of FIG. 4, the plate 171 is indexed to the new position desired. The platform 63 and the pusher plate 64 are changed to conform with the new size of the article array, and the wall retaining plate 71 is moved automatically by the adjustment of the glueing and final erection section D, to the appropriate plate, to conform with the new blank length. The entire glueing and final erection stage can be adjusted to the correct position by movement of the handwheels 83 and/or 88. As well as adjusting the adhesive applicator heads in both horizontal directions to cope with the changed size of blank, if required, as is necessary in some instances, the heads can be moved somewhat more to the right as shown in the drawings so that adhesive is applied in the third indexing position $P_3$ of the final erection stage D rather than in the second position $P_2$. The wall erecting plates 89 are adjusted with the new blank width by turning the handwheel 90 and with the new blank length by turning a further handwheel (not shown). The positions of the walls 92, 93 of the compression and adhesive setting portion and the rest position of the pusher plate of the pusher arrangement 94, are adjusted to conform with the new blank width.

The machine described above is believed to have several significant advantages over prior machines of this type. Due to the adjustability of its various parts, it can be readily adjusted to work with various different blank sizes which have now become standard in the packaging field, and, if required, with various non-standard sizes. No forming die is needed, which reduces the cost of making the machine and simplifies its adaption to use tray blanks of different sizes. Also, as there is no forming die down through which the blank and array of articles has to be moved, there is no particular difficulty in this respect in packaging tall articles such as bottles; and the main operative parts of the machine can be located at about the same horizontal level.

I claim:

1. A packaging machine for forming packages, each comprising an array of articles in a carton, from supplies of the articles and of carton blanks, the machine comprising a first carton blank positioning arrangement adjustable to suit carton blanks of different dimensions, such arrangement serving to receive and locate a blank and, upon such blank, one or more articles or groups of articles sufficient to form the desired array, such positioning arrangement including a downwardly movable platform for supporting the blank as the array of articles is formed thereon and a forming-die-less pair of adjustable opposed members arranged, upon downward movement of the loaded platform, to erect an opposed pair of wall portions of the blank around the array and to hold such wall portions in the erected position, at least one of the opposed members being movable to allow the blank with the array thereon to move from the platform to a second positioning arrangement for erection of another opposed pair of wall portions of the blank.

2. A packaging machine according to claim 1, in which one of the opposed members is movable out of the path of movement of the blank from the platform to the second positioning arrangement.

3. A packaging machine for forming packages, each comprising an array of articles in a carton, from supplies of the articles and of carton blanks, the machine comprising a first carton blank positioning arrangement adjustable to suit carton blanks of different dimensions, such arrangement serving to receive and locate a blank and, upon such blank, one or more articles or groups of articles sufficient to form the desired array, such positioning arrangement including a downwardly movable platform for supporting the blank as the array of articles is formed thereon and a forming-die-less pair of adjustable opposed members arranged, upon downward movement of the loaded platform, to erect an opposed pair of wall portions of the blank around the array and to hold such wall portions in the erected position, at least one of the opposed members being movable to allow the blank with the array thereon to move from the platform to a second positioning arrangement for erection of another opposed pair of wall portions of the blank, one of the opposed members being operably arranged, after the blank moves to the second positioning arrangement, to move back to a position where it holds erect the other one of the first-mentioned pair of wall portions.

4. A packaging machine according to claim 3, the platform being arranged to return to its initial position for supporting another blank, after the first blank with the array thereon has moved to the second positioning arrangement.

5. A packaging machine according to claim 3, a movable member being provided and operably arranged, after the platform completes its downward movement, to push the blank into the second positioning arrangement.

6. A packaging machine according to claim 5, in which the movable member is one of the opposed members.

7. A packaging machine according to claim 5, in which the initial and/or final positions of the movable member are adjustable.

8. A packaging machine according to claim 3, in which at least one of the opposed members is adjustable in position in the direction of movement of the blank to or from the platform.

9. A packaging machine according to claim 3, in which an adhesive application arrangement for applying adhesive to selected portions of the blank is associated with the second positioning arrangement.

10. A packing machine according to claim 9, in which the second positioning arrangement is adjustable with respect to the platform.

11. A packaging machine according to claim 3, in which the blanks are supplied to the platform from one side and are moved from the platform by way of the opposite side.

12. A packaging machine according to claim 11, in which the articles are supplied to the platform from a direction at right-angles to the direction of blank feed.

13. A packaging machine according to claim 3, wherein the second positioning arrangement includes arrangements for handling tray-form carton blanks so as to form packages where the array stands upon a rectangular tray having opposed pair of side and end walls and respective corner walls.

* * * * *